US007527171B2

(12) United States Patent
Ophardt et al.

(10) Patent No.: US 7,527,171 B2
(45) Date of Patent: May 5, 2009

(54) BOTTLE PIERCING DISPENSER

(75) Inventors: Heiner Ophardt, Vineland (CA); Andrew Jones, St. Catharines (CA)

(73) Assignee: GOTOHTI.COM Inc., Beamsville, Ontario (CA)

( * ) Notice: Subject to any disclaimer, the term of this patent is extended or adjusted under 35 U.S.C. 154(b) by 652 days.

(21) Appl. No.: 11/147,228

(22) Filed: Jun. 8, 2005

(65) Prior Publication Data

US 2006/0278655 A1 Dec. 14, 2006

(30) Foreign Application Priority Data

May 2, 2005 (CA) ..... 2506036

(51) Int. Cl.
*B67D 5/00* (2006.01)

(52) U.S. Cl. ..... 222/80; 222/86; 222/181.3; 222/478

(58) Field of Classification Search ..... 222/80, 222/85, 86, 181.1–181.3, 83, 83.5, 88, 478; 141/329, 330; 220/278; 414/42; 401/134, 401/135; 30/2; 83/660; 604/411, 414, 415
See application file for complete search history.

(56) References Cited

U.S. PATENT DOCUMENTS

| | | | |
|---|---|---|---|
| 1,980,434 | A | 11/1934 | Prahl |
| 2,049,541 | A | 8/1936 | Hatchel |
| 2,129,971 | A | 9/1938 | Smith |
| 2,134,127 | A | 10/1938 | Hopkins |
| 2,135,378 | A | 11/1938 | Allen |
| 2,156,527 | A | 5/1939 | Clark |
| 2,217,563 | A | 10/1940 | Sartain |
| 2,322,808 | A | 6/1943 | Hothersall |
| 2,505,369 | A | 4/1950 | Stewart |
| 2,654,507 | A | 10/1953 | Tuve |
| 2,655,286 | A | 10/1953 | Barbaro |
| 2,722,210 | A | 11/1955 | Koonce |
| 2,808,246 | A | 10/1957 | Chambers |
| 3,096,913 | A | 7/1963 | Corley |
| 3,193,147 | A | 7/1965 | Popp |
| 3,229,678 | A | 1/1966 | Anspach |
| 3,296,777 | A | 1/1967 | Jackson |

(Continued)

FOREIGN PATENT DOCUMENTS

| | | |
|---|---|---|
| EP | 0296130 | 12/1988 |

(Continued)

*Primary Examiner*—J. Casimer Jacyna
(74) *Attorney, Agent, or Firm*—Riches, McKenzie & Herbert LLP

(57) ABSTRACT

A fluid dispenser comprising a dispensing mechanism, a housing and a container having an interior. The container is removably coupled to the housing for dispensing fluid from the container by the dispensing mechanism. The housing has a guard recess opening downwardly and an access opening into the recess. A piercing member is secured in the recess. The container has a protuberance which is adapted to be received in the recess such that when the container is being coupled to the housing, the protuberance on the container is inserted upwardly into the recess and moved into the piercing member to pierce the protuberance with the piercing member. On the piercing member piercing the container, an air passageway is provided providing communication between the interior of the container and the atmospheric air. Preferably the piercing member is secured in the guarded recess against engagement other than with elements inserted into the recess via the access opening.

9 Claims, 13 Drawing Sheets

U.S. PATENT DOCUMENTS

| | | | | |
|---|---|---|---|---|
| 3,685,694 | A | | 8/1972 | Ianelli |
| 3,799,399 | A | | 3/1974 | DiBattista |
| 3,926,339 | A | | 12/1975 | Openchowski |
| 4,673,109 | A | | 6/1987 | Cassia |
| 4,699,296 | A | | 10/1987 | Schrock, Jr. |
| 4,706,849 | A | | 11/1987 | Ryan |
| 4,921,138 | A | | 5/1990 | Quinn |
| 4,998,850 | A | | 3/1991 | Crowell |
| 5,014,880 | A | * | 5/1991 | Loesel et al. ..... 222/181.2 |
| 5,353,965 | A | | 10/1994 | Lee |
| 5,373,970 | A | | 12/1994 | Ophardt |
| 5,431,309 | A | | 7/1995 | Ophardt |
| 5,489,044 | A | | 2/1996 | Ophardt |
| 5,597,093 | A | | 1/1997 | Lee |
| D378,035 | S | | 2/1997 | Ophardt |
| 5,638,989 | A | | 6/1997 | Ophardt |
| 5,975,360 | A | | 11/1999 | Ophardt |
| 6,070,762 | A | | 6/2000 | Klann |
| 6,409,050 | B1 | | 6/2002 | Ophardt |
| 6,644,509 | B1 | * | 11/2003 | Bublewitz et al. ..... 222/88 |
| 6,772,911 | B2 | | 8/2004 | Gee |

FOREIGN PATENT DOCUMENTS

| | | | |
|---|---|---|---|
| GB | 808 721 | | 2/1959 |
| GB | 1 105 497 | | 3/1968 |
| GB | 2 080 249 | A | 2/1982 |
| GB | 2 418 416 | A | 3/2006 |
| WO | WO 99/01061 | | 1/1999 |

* cited by examiner

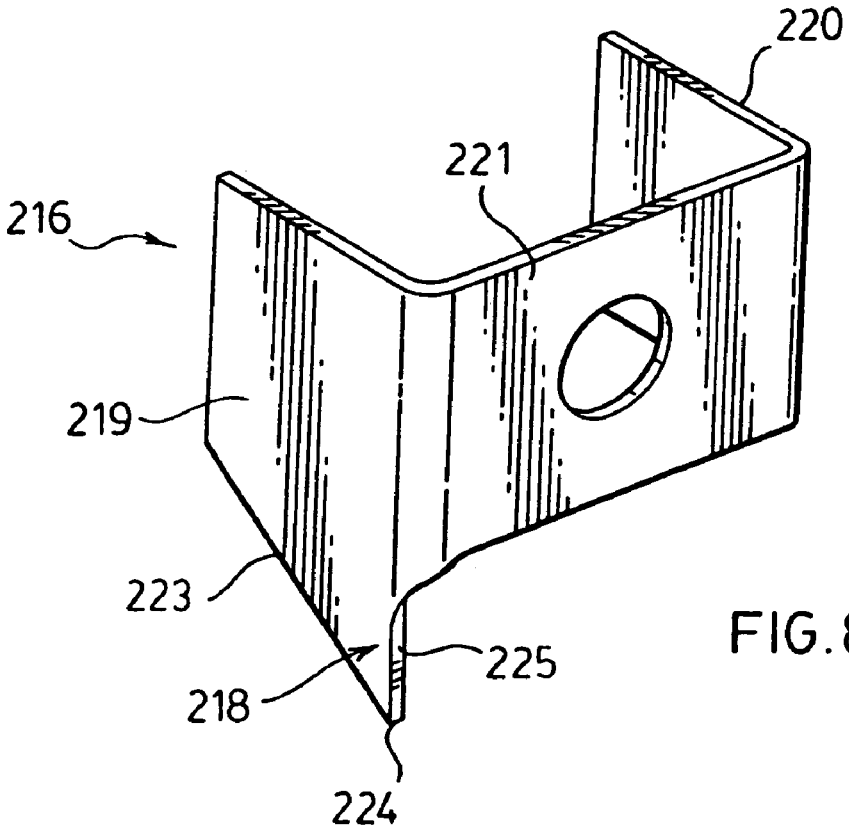
FIG.8.
FIG.9.
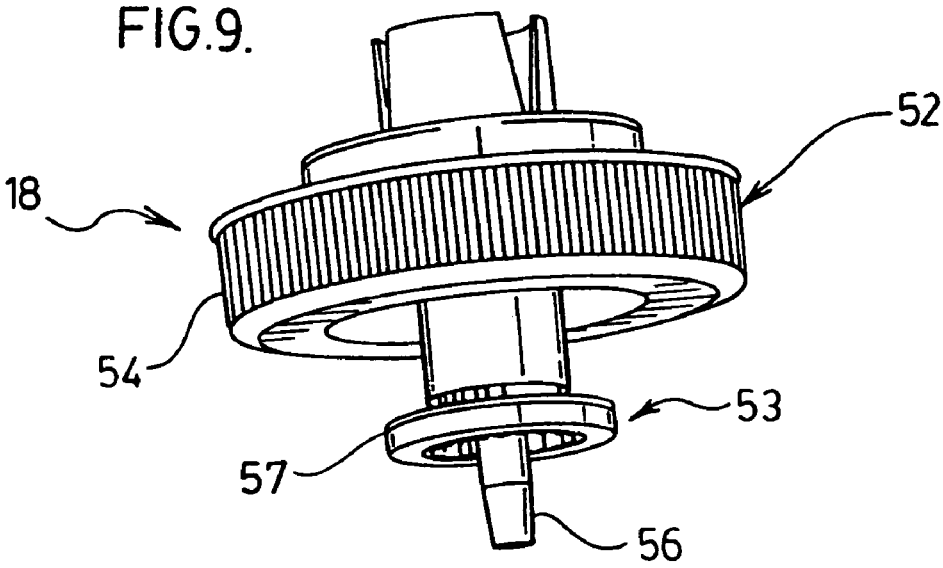

BOTTLE PIERCING DISPENSER

SCOPE OF THE INVENTION

This invention relates to a fluid dispenser and more particularly to a fluid dispenser having a replaceable fluid container such that with insertion of a container into the dispenser an air vent hole is pierced through the container.

BACKGROUND OF THE INVENTION

Dispensers are known which have a housing to receive a removable disposable non-collapsible fluid container which has an outlet opening from which fluid is to be dispensed. With containers which are not collapsible, to prevent vacuum from being developed within the container replacement air must be permitted to enter the container as fluid is dispensed. Known systems for permitting replacement air through dispensing pumps in the mouth of the container typically require more complex and expensive pump assemblies which have increased risk of failure as compared to non-venting pump assemblies. Provision of a pre-formed air vent passageway through a container has the disadvantages of providing another opening into the container which complicates manufacture and which may leak during storage.

SUMMARY OF THE INVENTION

To at least partially overcome these disadvantages of previously known devices the present invention provides a fluid dispenser in which on coupling of a removable container to the dispenser an air passageway opening is formed into the container, preferably by a piercing member which is safely located against accidental engagement.

An object of the present invention is to provide an improved fluid dispenser.

Another object is to provide a fluid dispenser with a piercing mechanism to provide an air passageway into a container during coupling of the container to the dispenser.

Another object is to provide a preferred construction for a bottle adapted to be coupled to a dispenser.

The present invention provides a fluid dispenser comprising a dispensing mechanism, a housing and a container having an interior. The container is removably coupled to the housing for dispensing fluid from the container by the dispensing mechanism. The housing has a guard recess opening downwardly and an access opening into the recess. A piercing member is secured in the recess. The container has a protuberance which is adapted to be received in the recess such that when the container is being coupled to the housing, the protuberance on the container is inserted upwardly into the recess and moved into the piercing member to pierce the protuberance with the piercing member. On the piercing member piercing the container, an air passageway is provided providing communication between the interior of the container and the atmospheric air. Preferably the piercing member is secured in the guarded recess against engagement other than with elements inserted into the recess via the access opening. This is advantageous such that in changing containers a user may not inadvertently engage themselves on the piercing member which typically is a sharp point, blade or cannula and is adapted for example to pierce the wall of the protuberance on the container. The container is preferably formed of plastic as by blow moulding and preferably as substantially non-collapsible and substantially rigid. The protuberance may be formed as a portion of the walls of the container which has relative reduced thickness and therefore facilitates piercing by the piercing member.

The container is preferably a bottle having an outlet opening at one end and at the other end the protuberance with the bottle adapted to be stored and shipped with the outlet opening, opening upwardly and the protuberance downwardly yet. When inserted into the dispensing apparatus the container is preferably inverted. Preferably the end of the container carrying the protuberance is also adapted to permit the container to be stored on a flat surface. Preferably, in coupling the container to the housing, the container is pivoted about a fulcrum member with in such pivoting of the container, the protuberance which is initially received in the recess is moved in the pivoting motion into the piercing member.

In one aspect the present invention provides a fluid dispenser comprising: a dispensing mechanism, a container having an interior, a housing, the container removably coupled to the housing for dispensing fluid from the container by the dispensing mechanism, the housing having a guard recess with an access opening thereinto which opens downwardly, a piercing member secured in the recess, the container having a protuberance adapted to be received in the recess, wherein in the container being coupled to the housing, the protuberance is inserted upwardly into the recess and moved into the piercing member to pierce the protuberance with the piercing member, the protuberance on piercing the container providing an air passageway providing communication between the interior of the container and atmospheric air.

DETAILED DESCRIPTION OF THE DRAWINGS

Further aspects and advantageous of the present invention will become apparent from the following description taken together with the accompanying drawings in which:

FIG. 8 is a perspective view of a knife element of the dispenser of FIG. 1;

FIG. 9 is a perspective view of a pump mechanism of the dispenser of FIG. 1;

DETAILED DESCRIPTION OF THE DRAWINGS

Figure 1:
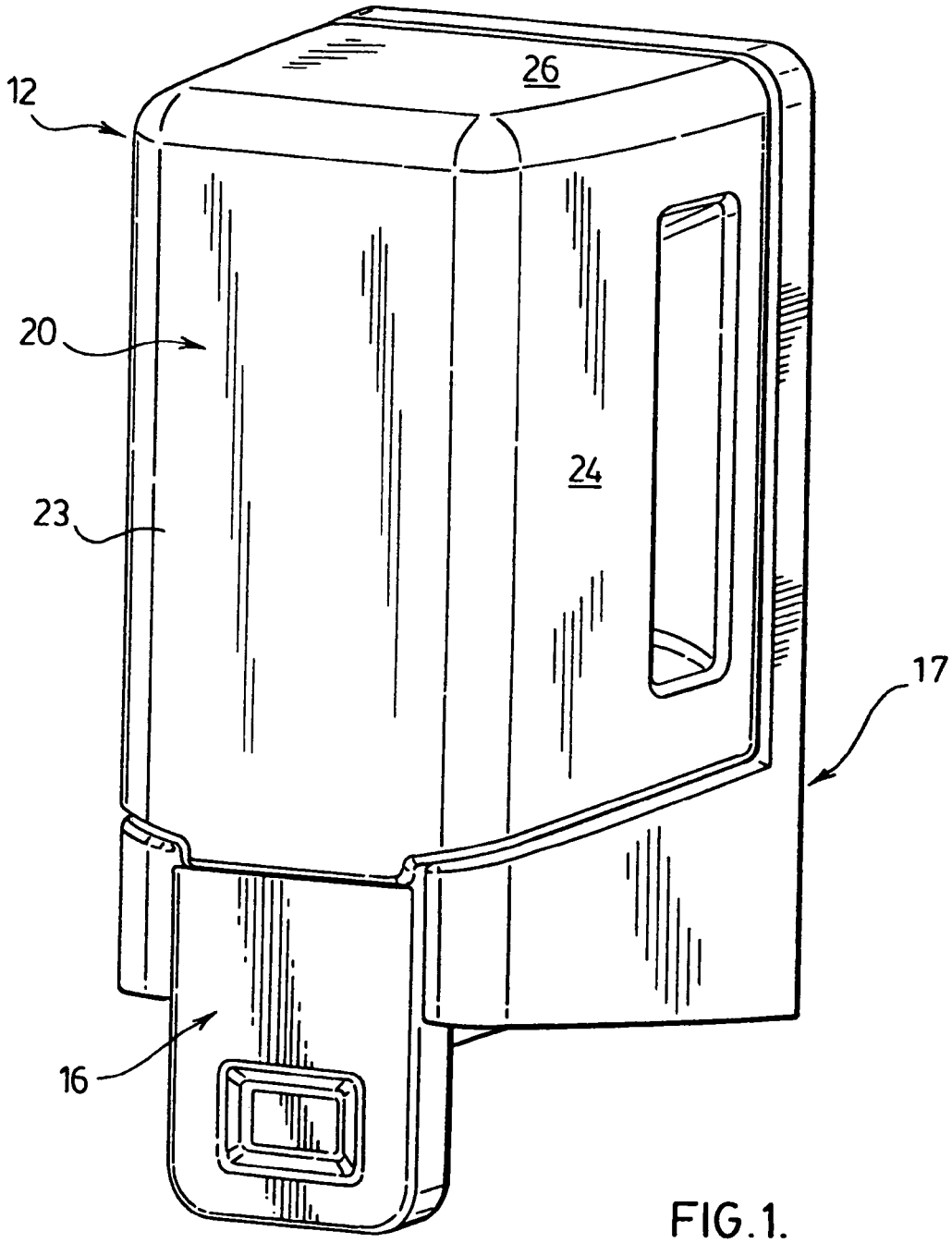
FIG. 1 is a front perspective view of a dispenser in accordance with a first embodiment of the invention with the container fully inserted onto the housing.
Figure 2:
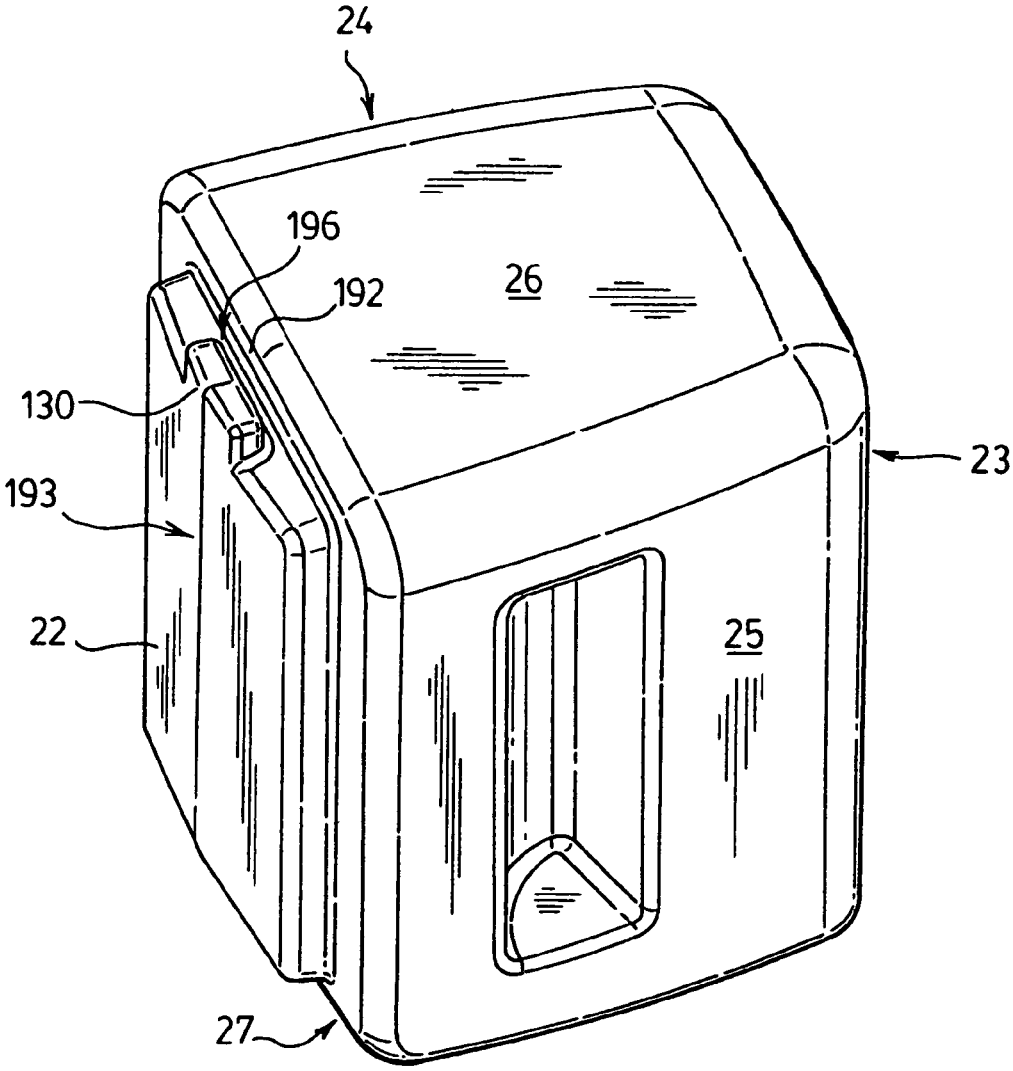
FIG. 2 is a side perspective view of the bottle of FIG. 1.
Figure 3:
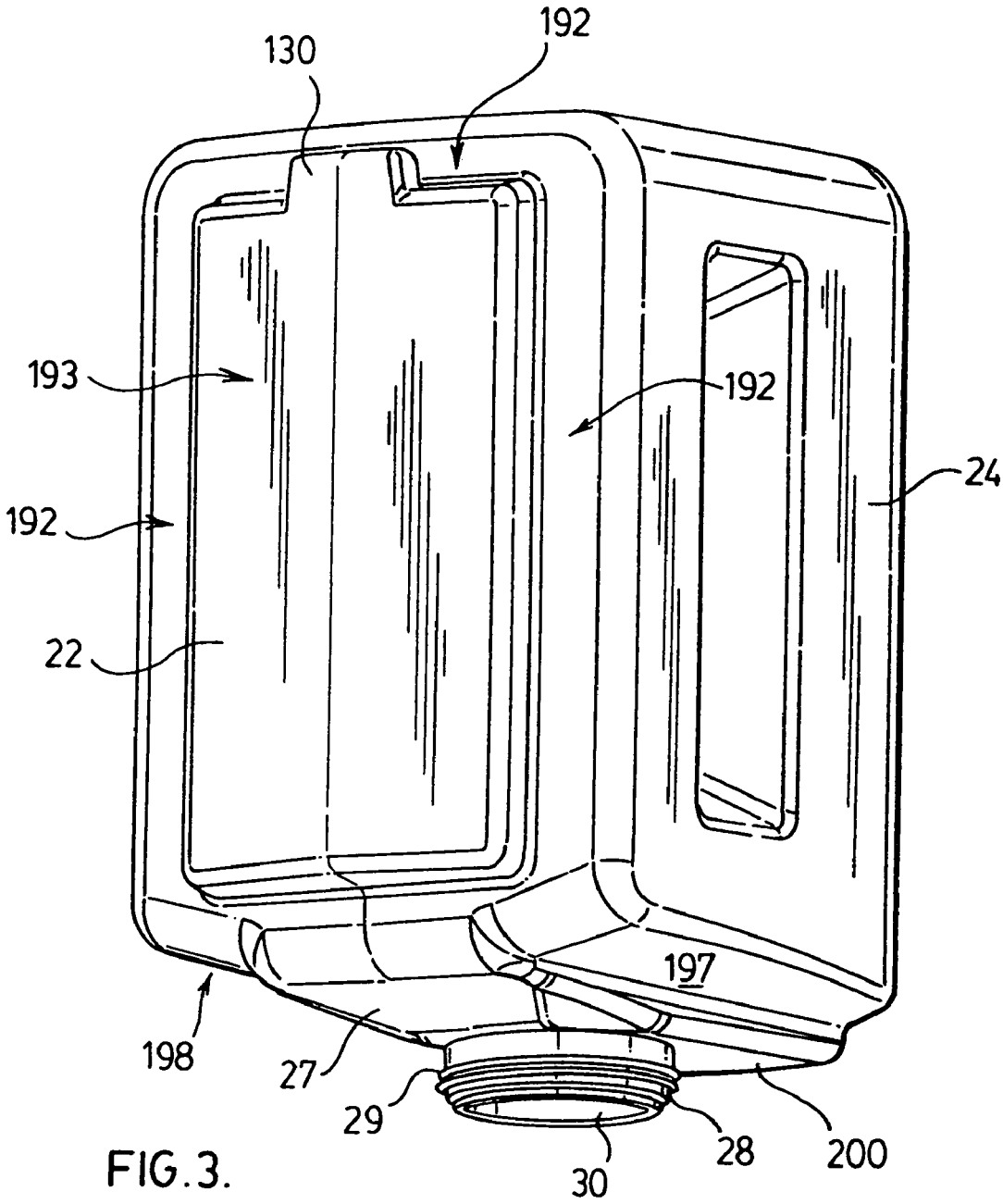
FIG. 3 is a rear perspective view of the bottle of FIG. 2.
Figure 4:
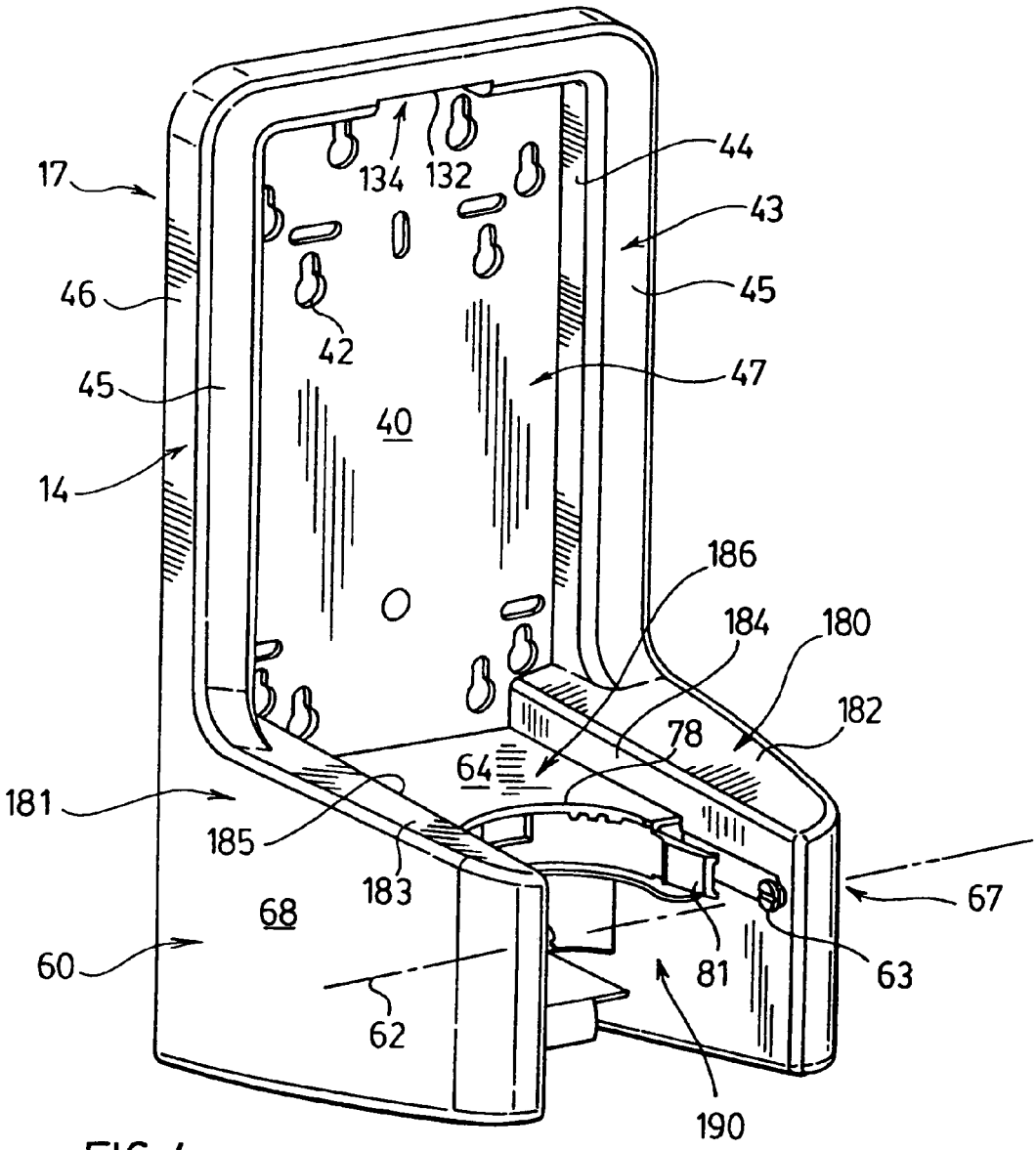
FIG. 4 is a front perspective view of the housing of FIG. 1.
Figure 5:
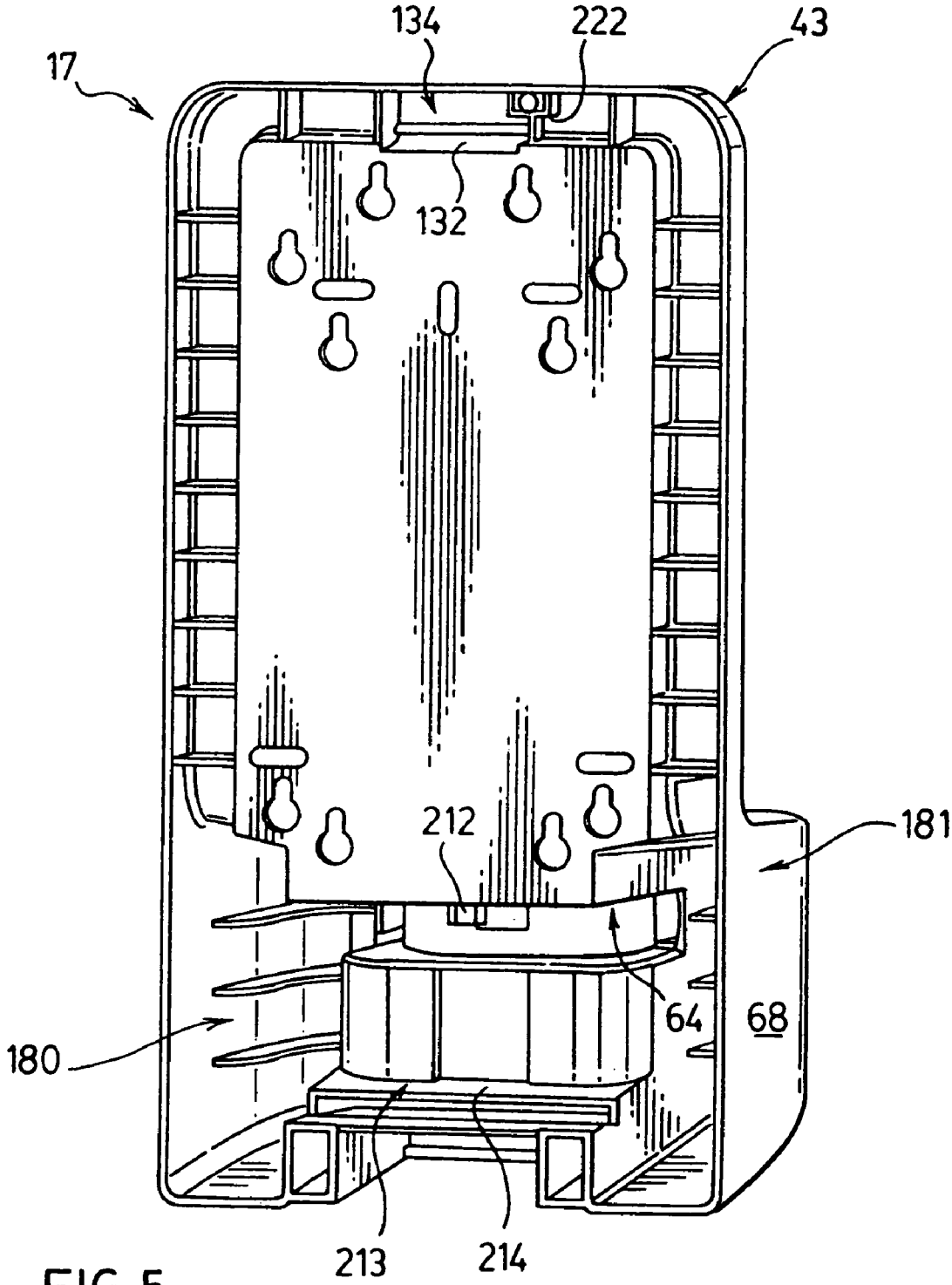
FIG. 5 is a rear perspective view of the housing of FIG. 4.
Figure 6:
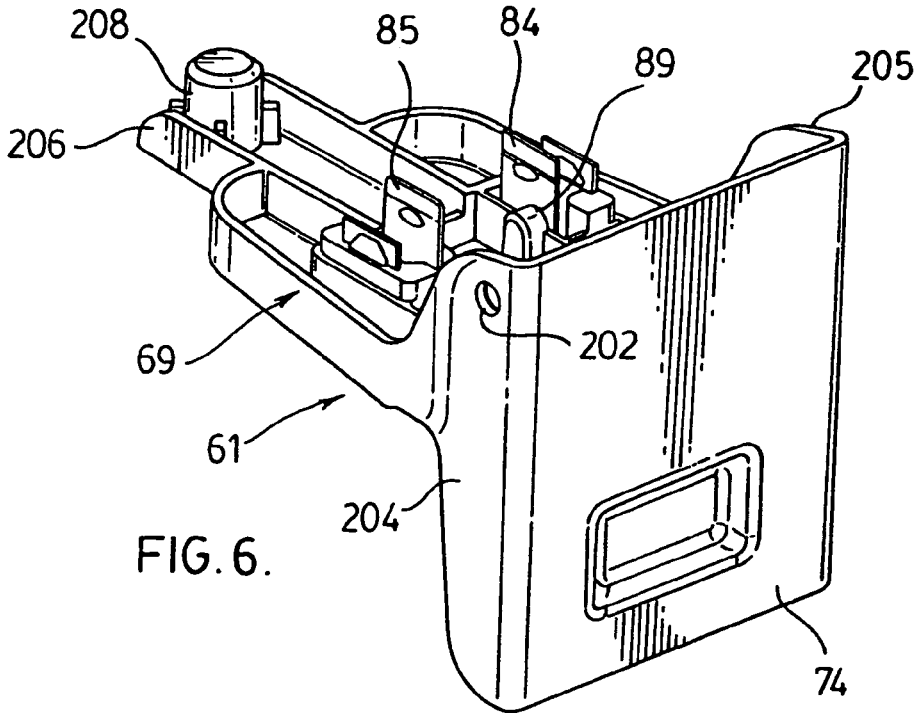
FIG. 6 is a front perspective view of the presser member of FIG. 1.
Figure 7:
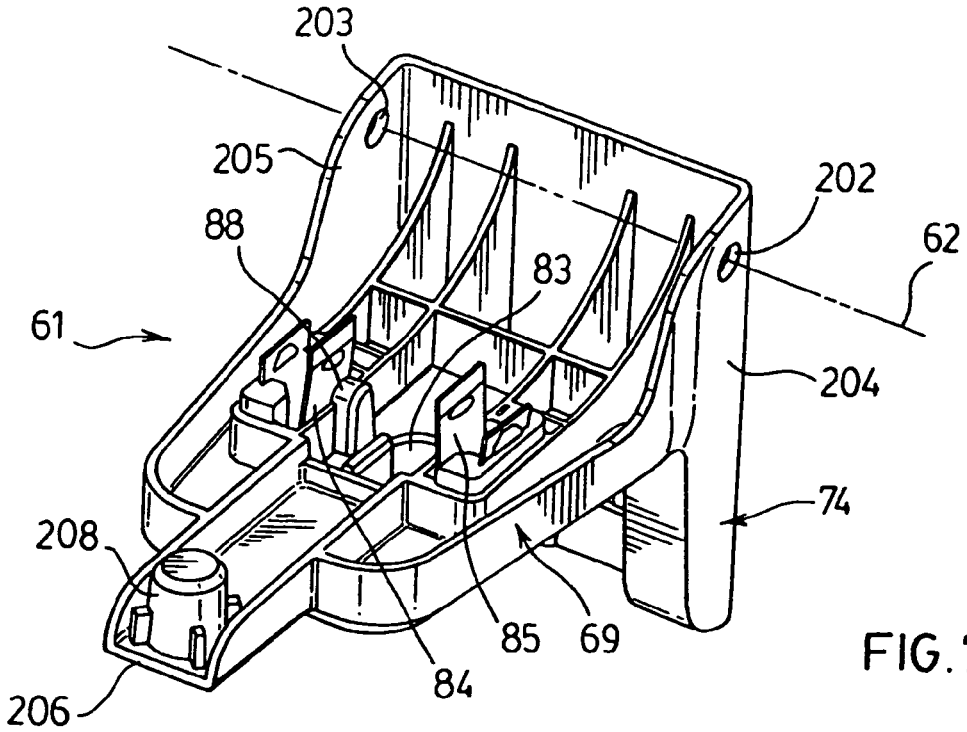
FIG. 7 is a rear perspective view of the presser member of FIG. 6.

Reference is made to the figures which show a dispensing unit 12 adapted to be removably coupled to a wall not shown. The dispensing unit 12 comprises an assembly of a reservoir container or bottle 20, a piston pump mechanism 18, a housing member 17 and an activation member 16.

The bottle 20 has a rear wall 22, a forward wall 23, two sidewalls 24 and 25, a top wall 26 and a bottom wall 27. A cylindrical externally threaded neck 28 carrying helical threads 29 extends downwardly from the bottom wall 27 and provides an exit outlet 30 for communication with the interior of the container.

The pump mechanism 18 comprises a piston chamber forming element 52 and piston member 53. The piston chamber forming element 52 is sealably engaged in the exit open in the bottle 20 with an internally threaded flange 54 threadably engaging the threaded neck 28 of the bottle 20 to locate the piston chamber forming element 54 coaxially within the neck 28. The piston member 53 is axially slidably received in the piston chamber forming element 52 for axial sliding therein coaxially between an extended position and a retracted position to dispense flowable materials from the bottle 20. When the pump mechanism 18 is coupled to the bottle, the flange 54 is spaced a distance from the bottom wall 27 of the bottle so as to provide an annular slotway 32 there between adapted for coupling of the bottle 20 to the housing member 17.

The housing member 17 comprises as a unitary member injection moulded from plastic including a lower support member 60 which extends forwardly and a wall plate member 14 which extends upwardly from the rear of the support member 60. The wall plate member 14 has a flat rear plate 40 for engagement as, for example, with a washroom wall proximate a sink. The wall plate member 14 may be secured to the wall by any means, preferably, by an adhesive such two-sided adhesive tape or by fasteners such as screws. Openings 42 to receive such fasteners are shown to extend through the rear plate 40. A peripheral flange member 43 extends along each side and the upper end of the rear plate 40 having an inwardly directed sidewall 44, a forwardly directed front wall 45 and an outer sidewall 46. A rear cavity 47 is defined between the rear plate 40 and the inner sidewalls 44 of the flange member 43.

The support member 60 has a support shelf 64 which extends forwardly from the rear plate 40. The support member 60 has sidewall members 180 and 181 which provide exterior sidewalls 67 and 68, upwardly directed top walls 182 and 183 and interior sidewalls 184 and 185. The sidewalls 184 and 185 extend downwardly from the top walls 182 and 183 at the rear of the support member 60 to merge with the support shelf 64 and provide, as bounded by the support shelf 64 and the interior sidewalls 184 and 185, a bottom locating cavity 186 closed at the rear by the rear plate 40. Similarly, the support shelf 64 and the interior sidewalls 184 and 185 and walls 182 and 183 of the sidewall members 180 and 181 close the lower end of the rear cavity 47. The support shelf 64 of the support member 60 has a generally semicircular opening 78 therein with two resilient fingers 81 extending forwardly therefrom on either side of the opening 78. The opening 78 opens forwardly into a central slotway 190 provided between the two sidewall members 180 and 181.

The bottle 20 has on its rear wall 22 a peripheral, rearwardly directed rear shoulder 192 from which a central rectangular rear locating plug 193 extends rearwardly. The rear locating plug 193 has a protuberance 130 at its upper rear which extends upwardly from the plug 193 spaced rearwardly from the rear shoulder 192. As seen, the protuberance 130 has an upper surface, lateral side surfaces, a rear surface and a forward surface 194. A slotway 196 is formed between the forward surface 194 of the protuberance 130 and the rear shoulder 192 forwardly thereof with an upper sidewall of the plug 193 forming a bight therebetween.

The flange member 43 of the wall plate member 14 has in its upper portion a central upwardly extending recess 134 formed with a downwardly facing access opening 132 upwardly into the recess 134. The opening 132 has a rectangular shape corresponding to the cross-sectional shape of the protuberance 130.

The bottom wall 27 of the bottle 20 has two downwardly directed side flange portions 197 and 198 extending from the front to the rear and a central bottom locating plug 200 extending downwardly therefrom from which the neck 28 extends centrally downwardly.

The bottle 20 is shaped and sided to fit within the housing member 17. In this regard, the flange 54 of the pump mechanism 18 is to be received in a snap fit relation in the opening 78 of the support member 60 with the support shelf 64 received in the slotway 32 about the neck of the bottle between the rear wall 22 of the bottle and the flange 54 of the pump mechanism 18. The bottom locating plug 200 is to be received in the bottom locating cavity 186 and the rear locating plug 193 is to be received in the rear locating cavity 47 with the protuberance 130 received in the recess 134. Engagement of the sidewalls of the rear locating plug 193 with the inner sidewalls 44 of the flange member 43 about the rear locating cavity 47 and engagement of the sidewalls of the bottom locating plug 200 with the interior sidewalls 184 and 185 of the side members 180 and 181 about the bottom locating cavity 186 assist in guiding the bottle into engagement with the housing member 17.

The presser member 61 is pivotally coupled to the support member 60 of the housing member 17 for pivoting about a hinge axis 62 by reason of two stub axles 63 extending inwardly from each of the sidewall members 180 and 181 of the support member 60 being received within pivot opening 202 and 203 in sidewalls 204 and 205 of the presser member 61. The presser member 61 includes a front hand lever 74 which extends downwardly from the hinge axis 62 and a support shelf 69 which extends rearwardly from the hand lever 74. The support shelf 69 carries on its rear end 206 a spring engagement post 208. A lower end of a helical coil spring 210 is engaged on this post 208 and extends upwardly therefrom to engage a locating post 212 which extends downwardly from the underside of the support shelf 64 of the support member 60. A bridge member 213 is provided extending sideways between the sidewall members 180 and 181 of the support member 60 which provides an upwardly directed bridge stop surface 214 which is engaged by the rear end 206 of the support shelf 69 so as to limit pivoting of the rear end 206 of presser member 61 downwardly. The presser member 61 is thus pivotally mounted to the support member 60 for pivoting between an extended position in which the rear end 206 of the support shelf 69 engages the bridge member 213 and retracted positions. Movement from the extended position to the retracted positions is accomplished by a user pressing rearwardly on a lower portion of the hand lever 74 compressing the spring 210. On release, the bias of the spring 210 will return the presser member 61 to the extended position.

The shelf 69 of the presser member 61 carries an elongate opening 83 through which the nozzle 56 of the piston member is to extend. On either side of the opening 83, the shelf 69 carries two resilient piston catch fingers 84 and 85 which are to engage the engagement flange 57 of the piston member 53 to couple the piston member 53 for movement with the presser member 61. The catch fingers 84 and 85 each carry a downwardly facing catch shoulder and to engage an upper surface of the engagement flange 57. The shelf 69 also has two upwardly extending arms on either side of the openings 83 presenting arcuate pivot shoulders 88 and 89 adapted to engage the lower surface of the engagement flange 57. Engagement flange 57 is to be received between the catch shoulders and the pivot shoulders 88 and 89 such that with arcuate movement of the presser member 61 relative the support member 60, the piston member 59 may slide in linear fashion relative the support member 60 axially relative the piston chamber forming member 52.

The catch fingers 84 and 85 are resilient and adapted to be deflected away from each other so as to permit the engagement flange 57 of the piston member 53 to move pass their distal ends such that after the bottle 20 and pump mechanism 18 have been secured to the support member, the piston member 61 may be pivoted towards the support member 60 and the distal ends of the catch fingers 84 and 85 will engage the side or lower surfaces of the engagement flange 57 and be biased apart such that catch fingers 84 and 85 will come to be disposed with their catch shoulders engaging the upper surface of the engagement flange 57.

A knife member 216 is secured to the wall plate member 14 so as to provide a piercing member 218 which extends downwardly into the recess 134. The knife member 216 is illustrated as a U-shaped piece of metal having two legs 219 and 220 and a bight 221 adapted to be secured to a rearwardly extending plug 222 mounted in the interior of the peripheral flange member 43 as by a screw extending forwardly through the bight 212 into the plug 222 with the legs 219 of the knife member 216 disposed vertically on either side of the plug 222. One of the legs 219 of the knife member extends beyond the bight downwardly forming the piercing member 218 with a sharp apex 224 adapted for piercing the wall of the bottle 20 in the protuberance 130.

Figure 10:
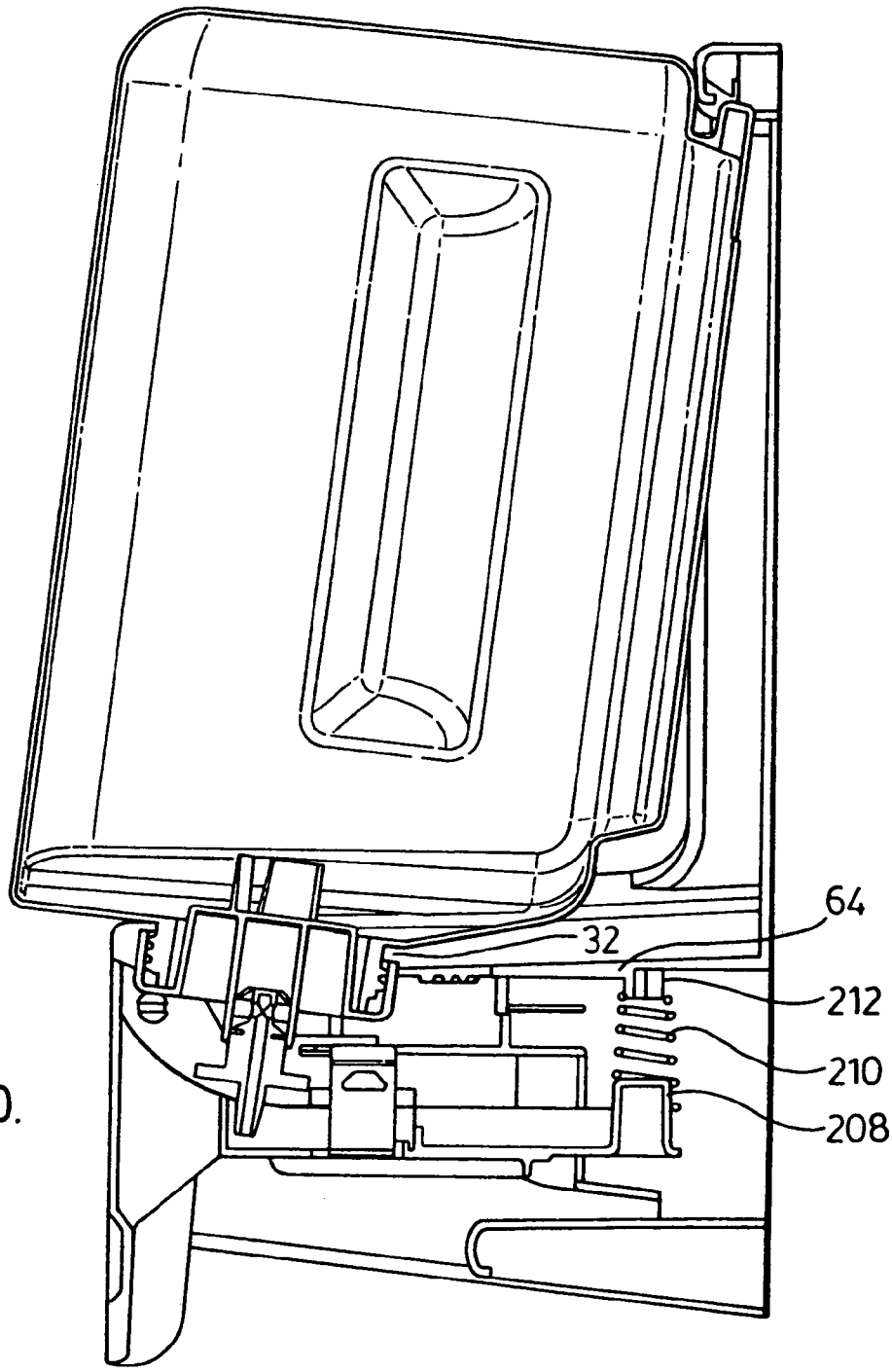
FIG. 10 is a schematic cross-sectional side view of the dispenser of FIG. 1 with the container in an unseated position.
Figure 11:
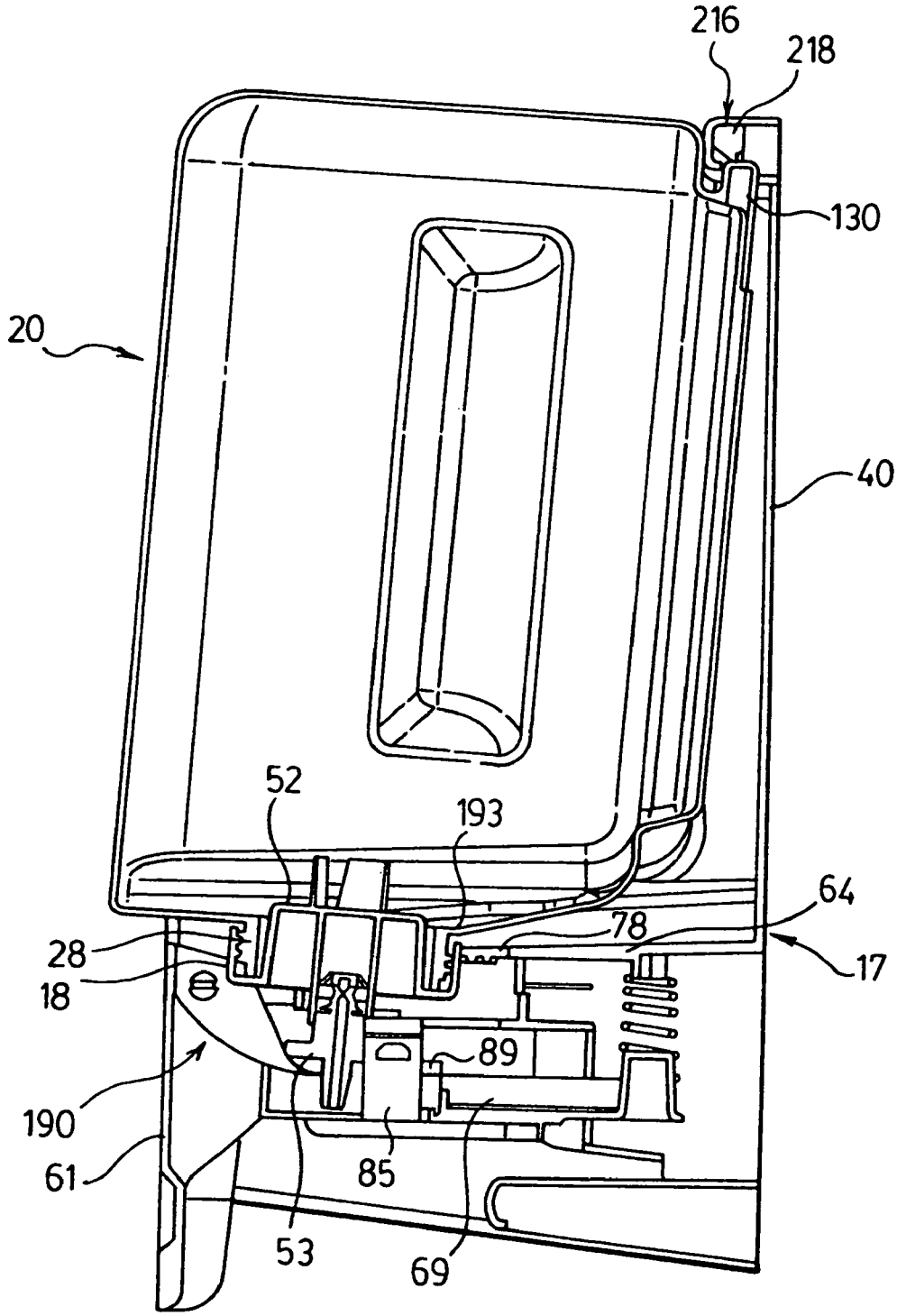
FIG. 11 is a view the same as FIG. 10 but with the container intermediate the seated position and the unseated position.
Figure 13:
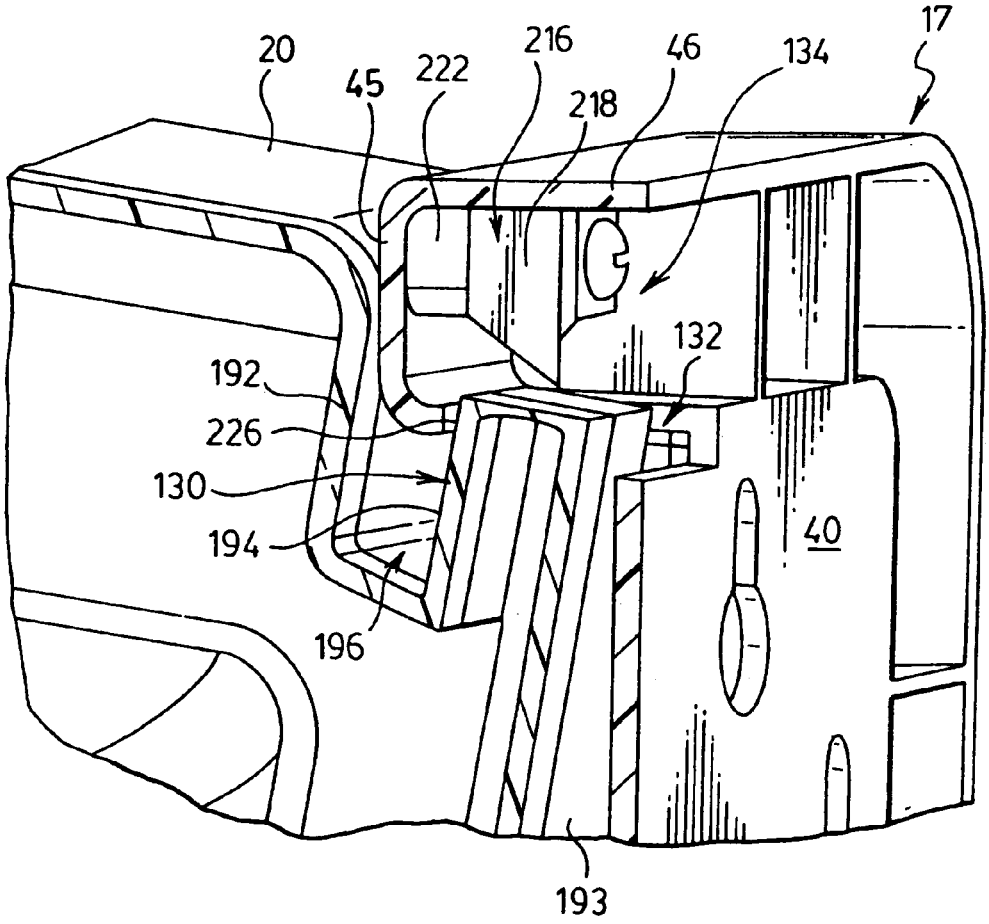
FIGS. 13, 14 and 15 are each an enlarged pictorial view of an upper rear portion of FIGS. 10, 11 and 12 respectively.
Figure 14:
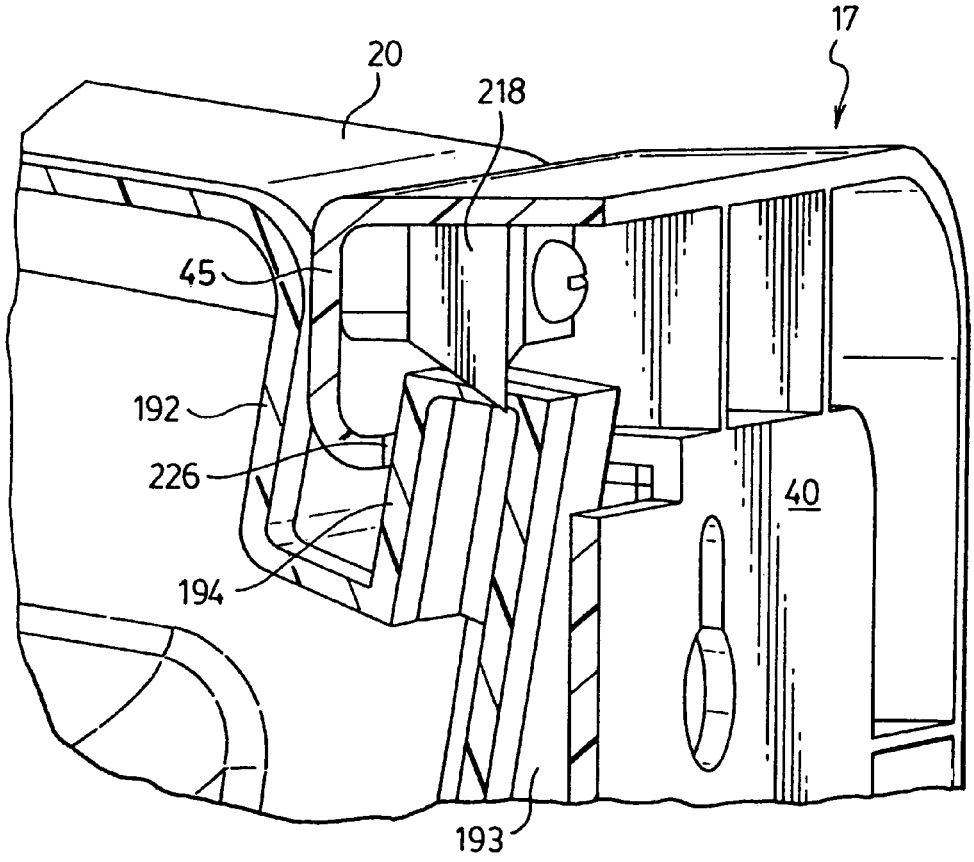

In use, the presser member 61 is coupled to the housing member 17 and this housing subassembly is then secured to a wall. The pump mechanism 18 is threadably engaged onto the bottle 20 and this subassembly is then coupled to the housing subassembly. For coupling, the bottle subassembly is placed into engagement with the housing subassembly in an unseated position as illustrated in FIGS. 10 and 13. As seen, the neck 28 of the bottle 20 with the pump mechanism 18 has been inserted vertically down into the slotway 196 in front of opening 78 and a rear portion of the bottom locating plug 193 is disposed in a forward portion of the bottom locating cavity 186 forward from the rear plate 40. The upper rear of the bottle 20 is angled rearwardly with the protuberance 130 received in the recess 134 with the upper end of the protuberance 130 above and rearward of a forward wall 226 of the recess 134 defining the access opening 132. An upper portion of the rear locating plug 193 is received in an upper portion of the rear locating cavity 47. The upper end of the protuberance 130 is in engagement with the piercing member 218. While in this unseated positioned, the lower front end of the bottle 20 is forced rearwardly with the bottle 20 moving from the unseated position of FIGS. 10 and 13 to an intermediate position of FIGS. 11 and 14 and subsequently to a fully seated position of FIGS. 12 and 15. While in the unseated position on the seated position and while moving from the unseated position to the seated position, the forward wall 226 of the recess 134 is received in the slotway 196 between the protuberance 130 and the rear shoulder 192 of the bottle 20 with a lower most portion of the forward wall 226 about the access opening 132 engaging the forward surface 194 of the protuberance 130. In this regard, the lower most portion of the forward wall 226 effectively forms a fulcrum member adapted to engage the forward surface 194 of the protuberance 130 which forms a pivoting surface. In moving from the unseated position of FIGS. 10 and 13 to the intermediate position of FIGS. 11 and 14 and hence to the seated position of FIGS. 12 and 15, the bottle 20 pivots about this fulcrum member in a pivoting motion. In this pivoting motion, the protuberance 130 moves upwardly into the recess 134 and in so doing the piercing member 218 commences to penetrate the wall of the protuberance 130 as best illustrated in FIG. 14 in the intermediate position and subsequently with further pivoting movement the piercing member 218 pierces through the wall of the protuberance forming an air passageway there through. With forward movement of the lower portion of the bottle 20 and the pump mechanism 18 carried thereon, the bottle subassembly comes to be securely coupled to the support member 60 by reason of the support shelf 64 being received in the slotway 32 and by reason of the flange 54 being received between the resilient fingers 81 which deflect outwardly to permit the flange 54 to enter the opening 78 in a snap fit relation with the resilient fingers 81 resisting movement of the flange 54 and hence the bottle assembly outwardly from the seated position in which the flange 54 is coaxially received within the rear semicircular portion of the opening 78. The side flange portions 197 and 198 of the bottom wall 27 of the bottle form a slide surface. When the bottle is in or between the unseated position and the seated position, with the fulcrum member being engaged on the pivoting surface 194 of the bottle and the slide surface 197/198 of the bottle engaged on the surfaces 182 and 183 of the support member, movement from the unseated position to the seated position results in engagement between the slide surface of the bottle and the support surfaces 182 and 183 urging the pivoting surface on the bottle into the fulcrum member on the housing. The bottle in moving between the unseated position and the seated position is jammed in friction fit between the fulcrum member and the support surfaces 182 and 183 with the fulcrum member engaging the pivoting surface to provide a point of contact about which the bottle is pivotable and with the support surfaces engaging the slide surface 197/198 to guide the slide surface in a path of motion which assists in pivoting the bottle about the fulcrum member.

At the same time that the bottle 20 and flange 54 become engaged in the seated position with the support member 60, the piston member 53 comes to become engaged with the presser member 61 with the engagement flange 57 of the piston member 53 becoming engaged with or disposed in a position for secured engagement between the catch fingers 84 and 85 and the pivot shoulders 88 and 89 and with the nozzle 56 aligned with the opening 83 through the shelf 69 of the presser member 61.

Figure 12:
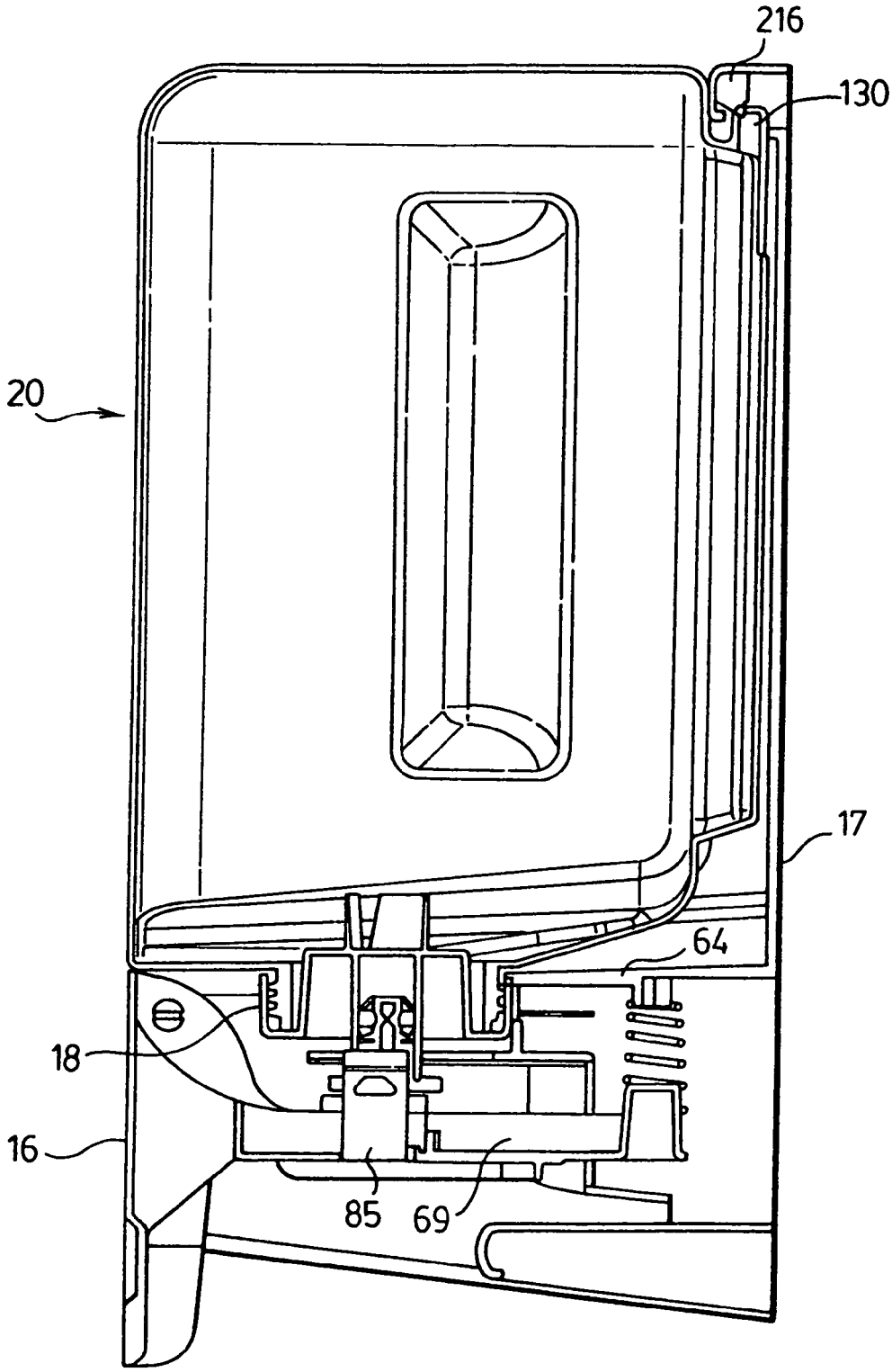
FIG. 12 is a view the same as FIG. 10 but with the container in a seated position.
Figure 15:
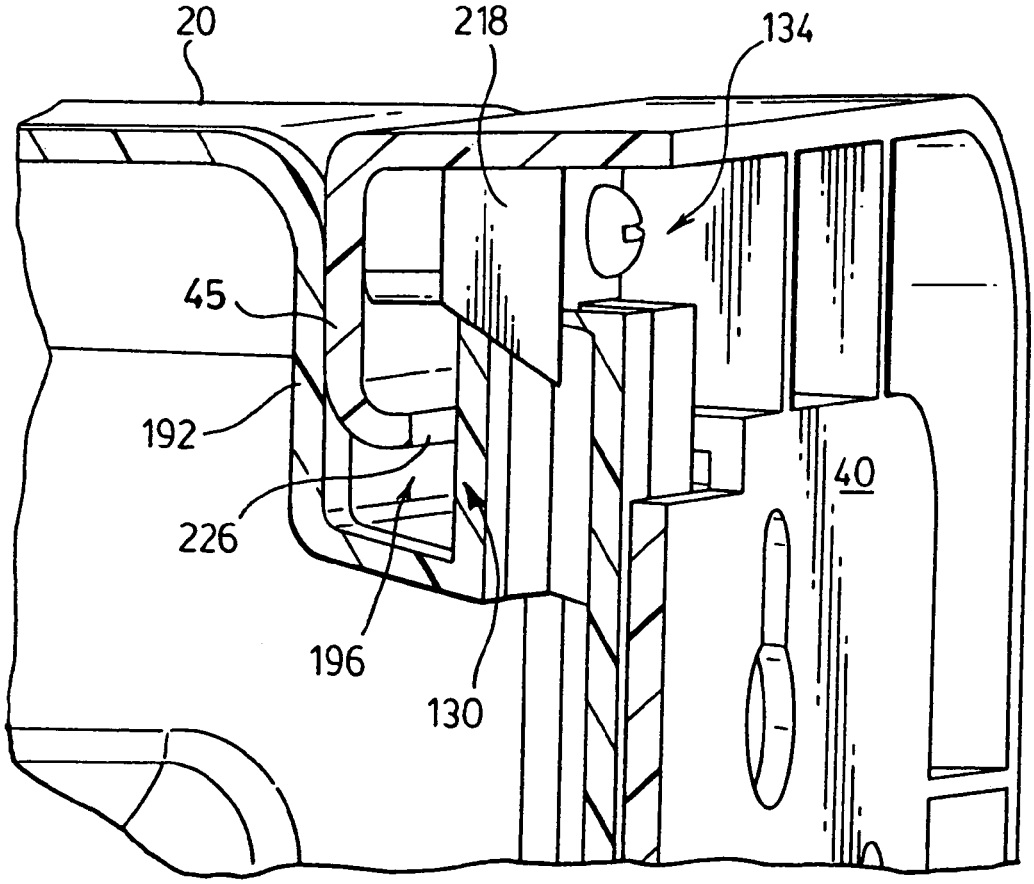

In a seated position as illustrated for example in FIGS. 12 and 15, towards presenting a pleasing appearance, the sidewalls 24 and 25 of the bottle 20 are provided substantially in the same plane as sidewalls of the housing member 17. Similarly, the top wall 26 of the bottle 20 is provided in the same plane as a top wall of the wall plate member 14 of the housing member 17. As well, the forward wall 23 of the bottle 20 closely matches the contours and planes formed by the forward surfaces of the sidewall members 180 and 181 of the support member 60 and the front face of the presser member 61. In this regard, the rear shoulders 192 of the rear wall 22 of the bottle 20 substantially mates and overlie the peripheral flange member 43 of the wall plate member 14. Similarly, the side flange portions 197 and 198 on the bottom wall 27 of the bottle 20 closely mate and overlie the top walls 182 and 183 of the sidewall members 180 and 181 of the support member 60.

In the preferred embodiment of FIG. 1, the piercing member 218 is secured in the recess 134 spaced upwardly inside the recess 134 in a manner such that engagement other than with elements inserted upwardly into the recess 134 via its access opening 132 is prevented. This is preferred so as to minimize potential danger to users when a bottle may not be coupled to the housing member 17 against accidentally cutting themselves on the piercing member 218.

Various additional protection devices may be provided so as to prevent and/or preclude inadvertent engagement of the piercing member 218 by a user when the bottle is removed. For example, a slide block member (not shown) could be provided which slides longitudinally in the recess 134 below the piercing member 218 and which is spring biased to assume a position when the bottle 20 is removed that the blocking member lies underneath the piercing member 218. The blocking member may be accessible as by a slide button protruding from the upper top surface of the peripheral flange member 43 above the recess 134. For insertion of a bottle 20, the bottle is placed in the unseated position and while in this position the blocking member is manually slid laterally to one side out from under the piercing member 218 and with the blocking member moved to one side the bottle 20 may then be moved in a pivoting motion from the unseated position to the seated position. On removal of any bottle, the blocking member will under the spring bias slide back into a position underneath the piercing member 218.

The piercing member 218 has been shown as a vertically extending blade with a front edge 223 which angles downwardly to the rear to a rear apex 224 where the forward edge intersects with a vertically downwardly extending rear edge 225.

The piercing member 218 serves the purpose of piercing the bottle wall so as to provide an air passageway through the bottle wall which provides communication between the interior of the bottle and atmospheric air. The pump mechanism 18 is operative to dispense volumes of fluid from the container 20 preferably without permitting atmospheric air to pass upwardly into the container through the bottle outlet 30. Insofar as the dispensing mechanism is operative to dispense volumes of fluid from the bottle greater than volumes of atmospheric air which can or may be permitted to pass inwardly into the container via the outlet 30 then a vacuum may be developed within the bottle. The air passageway formed by the piercing member 218 through the protuberance 130 permits atmospheric air to enter the interior of the bottle and limit any vacuum from being developed in the bottle.

The bottle 20 is preferably a substantially non-collapsible, substantial rigid container preferably formed by plastic as for example by blow moulding. Preferably, the thickness of the wall of the bottle 20 on the protuberance 130 where the piercing member 218 is to pierce the wall has a reduced thickness compared to other portions of the wall of the bottle to facilitate the piercing member 218 piercing the protuberance 130.

The air passageway need not provide an actual opening through the wall at all times. The piercing member 218 may effectively be reviewed in the opening formed through the protuberance 130 in a somewhat sealed manner. However, the walls of the bottle 20 forming the protuberance 130 may be of a resilient nature such that on some degree of vacuum being developed within the bottle, the walls about the opening will deflect away from the piercing member 218 and readily permit air to enter the bottle without any substantial vacuum being created.

The piercing member 218 may however be configured such that on penetrating the bottle that an actual opening is formed and created which at all times remains open. For example, the piercing member may comprise a hollow needle like structure or cannula which internally will provide a passageway there through. The cutting member may have a generally V-shaped cutting knife which will in fact remove amounts of the wall as the protuberance 130 is pivoted upwardly thus providing at least some portions of the air passageway which are always open and provide a continuously open passageway through the wall.

The bottle 20 shown provides its neck 28 and outlet 30 at one end of the bottle and provides the top wall 26 at another end with the protuberance 130 proximate the other end. For storage and shipment of the reservoir bottle, the bottle 20 is inverted from the position illustrated in the Figures to an upright position. In this upright position, the top wall 26 provides a flat surface for the bottle to be supported on a flat support surface and the protuberance 130 is displaced from the top wall 26 so as to not interfere with support of the bottle on such a support surface.

In the embodiment illustrated, the resilient fingers 81 about the forward end of the opening 78 provide a retention mechanism to releaseably retain the bottle 20 in the seated position against movement towards the unseated position. Various other retention mechanisms may be provided as for example by various catch shoulders on the bottle as on its sidewalls to engage on corresponding catch members on the support member 60 or the wall plate 14.

The preferred embodiment of this invention illustrates one version of a bottle with the pump mechanism attached. Various other bottles may be secured to other dispensing arrangements using the same arrangement that is with a protuberance carried on the bottle and the bottle being pivoted by the fulcrum member such that a protuberance on the bottle on moving from an engaged unseated position to an engaged seated position comes to have its wall pierced by a piercing member. The outlet preferably is provided on the bottle at an opposite end to the protuberance however this is not necessary and it is to be appreciated that an outlet could be provided at the same end of the bottle as the protuberance as for example for dispensing using a pump mechanism including a dip tube which extends downwardly into the bottle.

Use of a bottle with a piercing mechanism as illustrated has the advantage that it is difficult for a user to reuse the bottle as by removing the bottle and attempting to refill it. The preferred dispenser illustrates an arrangement in which the wall plate and support member are integrally provided as part of the housing member 17 and the presser member 61 is provided with separately. Various other arrangements may be provided with separate wall plates, support members and/or actuator members without limit. The spring is illustrated as being a metal spring however various other forms of springs may be provided. Similarly, the pump mechanism has been illustrated as a piston pump mechanism but other pumping mechanisms may be provided which may or may not be coupled to the bottle at the time of insertion.

The nature of the fluid which may be dispensed by the bottle is not limited and may comprise any substantially flowable material including liquids, fluids, solutions, pace and as well a flowable solid and particulate matter where venting to provide an air passageway can be advantageous. While the invention has been described with reference to the preferred embodiments many variations and modifications will now occur to persons skilled in the art. For a definition of the invention reference is made to the following claims.

We claim:

1. A fluid dispenser comprising:

a dispensing mechanism, a container having an interior defined within walls of the container, a housing, the container removably coupled to the housing for dispensing fluid from the container by the dispensing mechanism, the housing having a guard recess with an access opening thereinto which opens downwardly, a piercing member secured in the recess, the container having a protuberance adapted to be received in the recess, wherein in the container being coupled to the housing, the protuberance is inserted upwardly into the recess and moved into the piercing member to pierce the protuberance with the piercing member, the protuberance on piercing the container providing an air passageway providing communication between the interior of the container and atmospheric air, the protuberance is provided on an upper rear of the container, the protuberance having a lower end coupled to container with the protuberance extending upwardly from the lower end to a distal upper end forming a forwardly directed face on the protuberance between the lower end and the upper end, the opening of the guard recess defined rearwardly of a forward wall of the guard recess extending downwardly to a lower edge, the forwardly directed face on the protuberance forming a rear wall of a laterally and downwardly extending slotway in the container forward of the protuberance, wherein when the container is coupled to the housing with the protuberance extending upwardly into the recess, the forward wall of the guard recess extends downwardly into the slotway with the lower edge located in the slotway forward of the forwardly directed face on the protuberance, the interior is defined within container walls, the container is a substantially non-collapsible, substantially rigid container closed but for having an outlet opening through which fluid is dispensed from the container by the dispensing mechanism, the dispensing mechanism operative to dispense volumes of fluid from the container greater than volumes of atmospheric air permitted to pass inwardly into the container via the dispensing mechanism, the piercing member forming the air passageway through the protuberance to permit atmospheric air to enter the container and limit a vacuum from being developed in the container, wherein the container is movable relative the housing from an unseated position to a seated position to couple the container to the housing and from the seated to the unseated position to uncouple the container from the housing, wherein in moving the container relative to the housing from the unseated position to the seated position, the piercing member piercing the protuberance to form said air passageway and in the seated position, the protuberance maintaining the air passageway open, wherein in the unseated position, the protuberance is at least partially received within the recess, and in moving the container relative the housing to the seated position, the protuberance moves sufficiently into the recess that the piercing member pierces the protuberance, the housing includes a downwardly directed fulcrum member on the housing, a pivot surface on the container being upwardly directed when the container is in or between the unseated position and the seated position, in movement of the container between the unseated position and the seated position, the pivot surface on the container and the fulcrum member engaging each other so as to guide the container in a pivoting motion about the fulcrum member in moving between the unseated position and the seated position and in which in such pivoting motion of the container the protuberance is moved inwardly into the recess and into the piercing member to have the piercing member pierce the protuberance, the lower edge of the forward wall of the guard recess forming the fulcrum member, the pivot surface on the container provided as an upwardly directed surface forward from the protuberance.

2. A dispenser as claimed in claim 1 wherein the protuberance comprises a portion of the walls of the container having a reduced thickness to facilitate the piercing member piercing the protuberance.

3. A dispenser as claimed in claim 2 wherein the housing includes an upwardly directed lower container support member spaced below the recess, the container having on an opposite side thereof from the pivot surface a slide surface, when the container is in or between the unseated position and the seated position, with the fulcrum member is engaged on the pivot surface of the container and the slide surface of the container is engaged on the lower container support surface wherein in movement from the unseated position to the seated position, engagement between the slide surface of the container and the lower container support surface urging the pivot surface on the container into the fulcrum member on the housing.

4. A dispenser as claimed in claim 3 wherein the container in moving between the unseated position and the seated position is jammed in a friction fit between the fulcrum member and the lower support surface with the fulcrum member engaging the pivot surface to provide a point of contact about which the container is pivotable and with the lower support surface engaging the slide surface to guide the slide surface in a path of motion which assists in pivoting the container about the fulcrum member.

5. A dispenser as claimed in claim 2 wherein the container is formed from plastic material.

6. A dispenser as claimed in claim 3 wherein the dispenser has the outlet opening at a first end and the protuberance at the second end, the slide surface provided on the container at the first end on either side of the outlet opening.

7. A dispenser as claimed in claim 6 wherein at the second end, the walls of the container provide support surfaces for supporting the container for storage and shipment on a flat substrate, the container being adapted for inversion for insertion into the housing in the unseated position and for movement in the inverted position between the unseated position and the seated position.

8. A dispenser as claimed in claim 6 wherein the container is formed from plastic material.

9. A dispenser as claimed in claim 1 including a retention mechanism to releasably maintain the container in the seated position against movement toward the unseated position.

* * * * *